United States Patent [19]

Hildebrand

[11] Patent Number: 5,045,758

[45] Date of Patent: Sep. 3, 1991

[54] SOLID STATE REGULATED POWER SUPPLY FOR LUMINESCENT LAMP

[76] Inventor: Cleve R. Hildebrand, 22435 Shadycroft Ave., Torrance, Calif. 90505

[21] Appl. No.: 514,274

[22] Filed: Apr. 25, 1990

[51] Int. Cl.[5] ..... H05B 37/02

[52] U.S. Cl. ..... 315/151; 315/158; 315/307

[58] Field of Search ..... 315/151, 155, 156, 158, 315/291, 307

[56] References Cited

U.S. PATENT DOCUMENTS

| | | | |
|---|---|---|---|
| 3,901,813 | 8/1975 | Potopinski | 315/156 |
| 3,965,388 | 6/1976 | Brisk | 315/155 |
| 3,989,980 | 11/1976 | Berman | 315/158 |
| 4,104,562 | 8/1978 | DiCola | 315/158 |
| 4,114,366 | 9/1978 | Renner | 315/156 |
| 4,227,119 | 10/1980 | Murata | 315/156 |
| 4,368,406 | 1/1983 | Kruzich | 315/156 |
| 4,467,246 | 8/1984 | Tanaka | 315/151 |
| 4,605,882 | 8/1986 | Deluca | 315/158 |
| 4,682,084 | 7/1987 | Kuhnel | 315/151 |
| 4,701,669 | 10/1987 | Head | 315/151 |

*Primary Examiner*—Eugene R. LaRoche
*Assistant Examiner*—A. Zarabian

[57] ABSTRACT

A solid state power supply and light emission controller for a luminescent lamp which converts alternating current line voltage, or direct current voltage, into a constant repetition rate, variable width pulse alternating current voltage for energizing the lamp and for controlling the light emission of the lamp. The power supply provides essentially constant contrast (light brightness ratio) in the light emission from the lamp in the presence of variations in ambient light level. The system achieves its desired result by sensing the ambient light level and also by sensing the level of the light emitted by the lamp. The luminescent lamp may, for example, be a neon lamp, a white light fluorescent lamp, an incandescent lamp, or the like.

6 Claims, 5 Drawing Sheets

SOLID STATE REGULATED POWER SUPPLY FOR LUMINESCENT LAMP

BACKGROUND OF THE INVENTION

The power supply of the invention finds particular utility in external pedestrian crossing signals, or other types of signals, for maintaining the signals effective and visible over a defined range of ambient light levels. This is achieved by maintaining a constant contrast (brightness ratio) between the light level of the signal and the ambient light level. Such control of the light level of the signal is important because if the signal is too dim for a particular ambient light level it is difficult to discern, and if it is too bright it tends to cause glare.

It is, accordingly, a general objective of the present invention to provide a simple and inexpensive solid state regulated power supply for a luminescent lamp which enables the lamp to generate a variable light emission level in the presence of variations in ambient light levels so as to maintain a constant brightness ratio between the two light levels.

SUMMARY OF THE INVENTION

A solid state power supply and light emission controller for a luminescent lamp is provided. The power supply controls the light emission from the lamp so as to provide essentially constant contrast in the presence of variations in the ambient light level. This is achieved by generating a first signal indicative of the ambient light level; by generating a second signal indicative of the level of the light emitted by the lamp, and by utilizing the two signals to regulate the output of the power supply.

DETAILED DESCRIPTION OF THE ILLUSTRATED EMBODIMENT

The solid state power supply illustrated in the circuit of FIG. 1 accomplishes the objective of the invention by utilizing two light sensors $R_1$ and $R_a$ one to monitor lamp brightness and the other to monitor ambient light. The light brightness monitor sensor $R_1$ is the key element since lamp efficiency varies widely so that lamp brightness cannot be accurately established by an open loop control of the power delivered to the lamp.

The basic purpose of the power supply shown in FIG. 1 is to provide a variable source of high voltage power for a luminescent lamp in such a manner that the power delivered is automatically adjusted to a level such that the brightness of the lamp is maintained in a constant ratio with respect to the ambient light falling on the lamp.

Figure 1A:
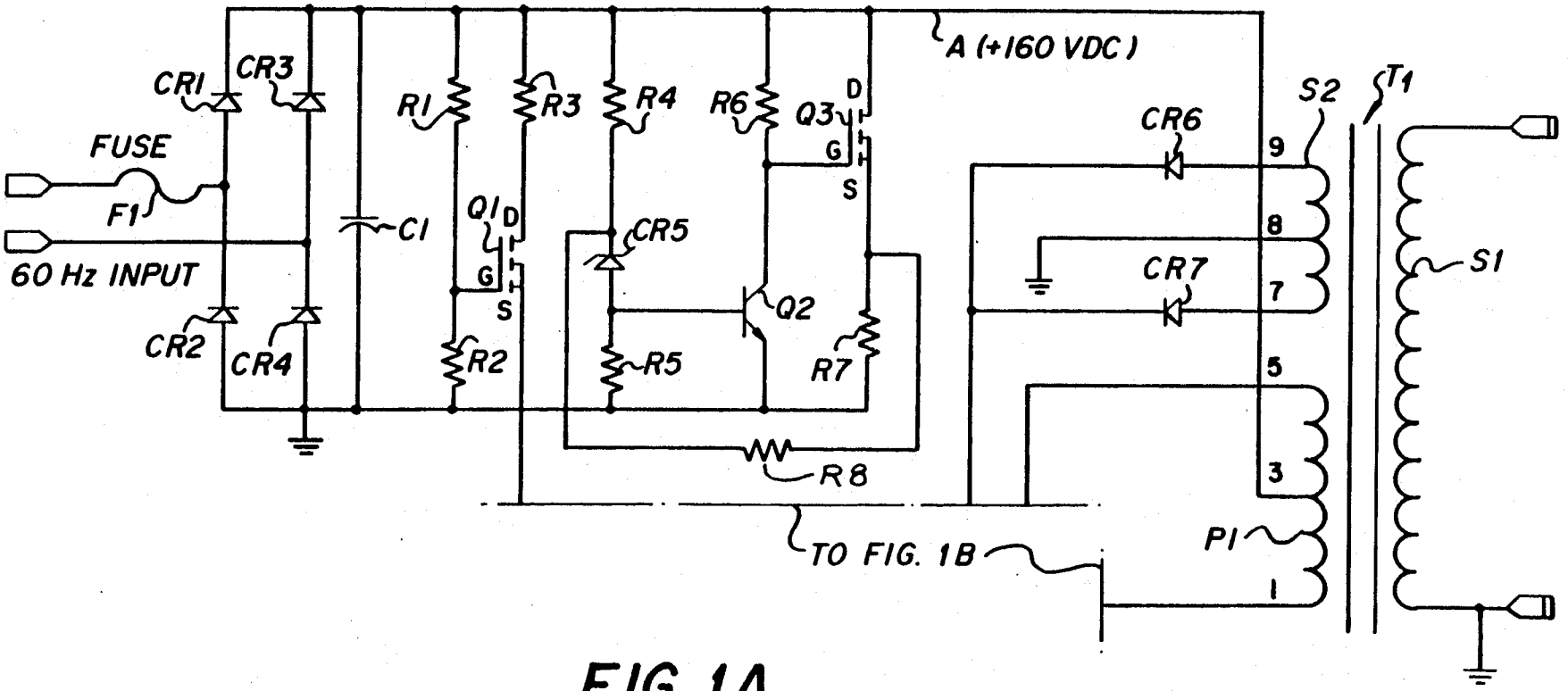
FIGS. 1A and 1B collectively illustrate a circuit diagram of a power supply constructed to embody the concepts of the present invention in one of its embodiments.
Figure 1B:
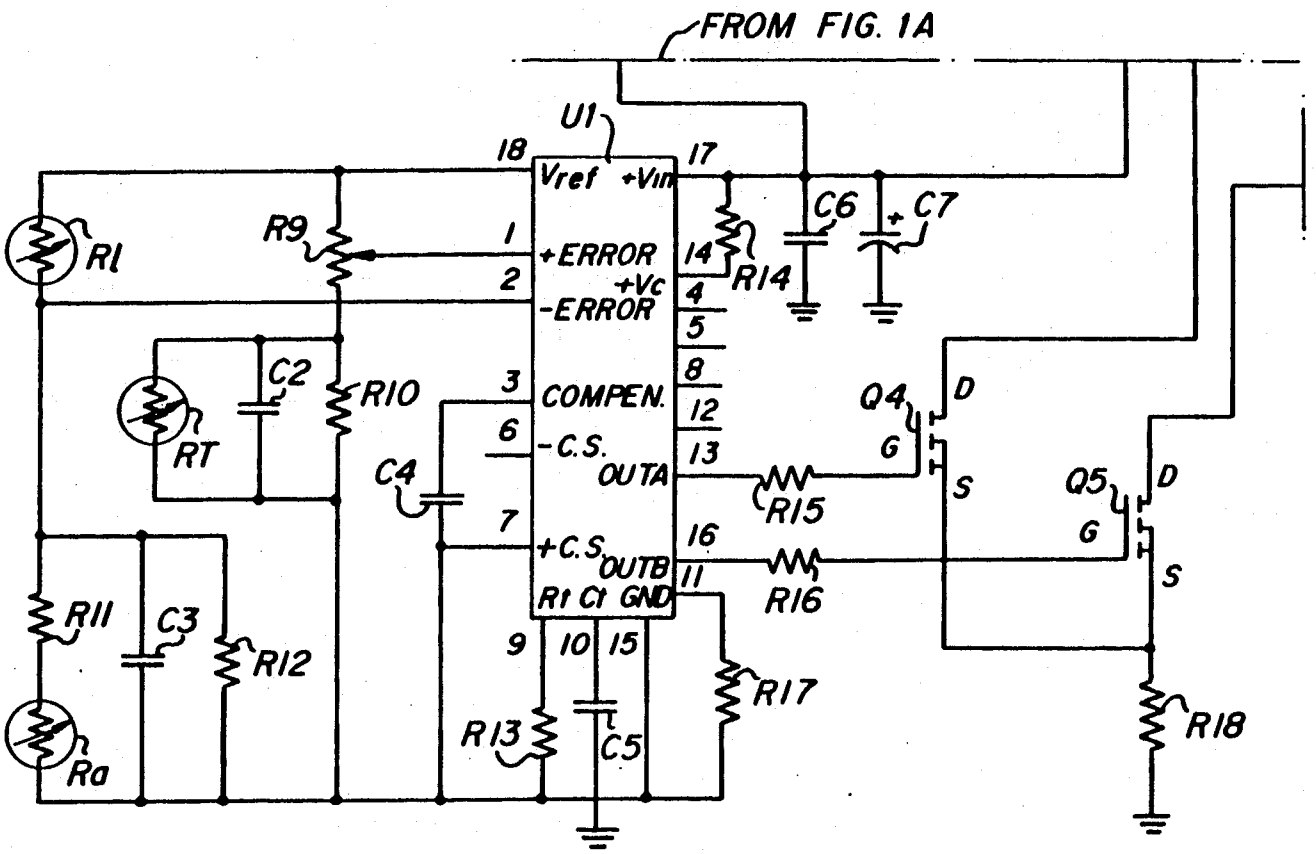

As shown in FIGS. 1A and 1B, the power supply is made up of six functional components identified as follows:

1. Rectifier bridge and storage capacitor circuit.
2. Start-up supply circuit.
3. Dynamic load circuit.
4. Operating supply circuit.

5. Sensor bridge circuit.
6. Switching regulator circuit.

The rectifier bridge is made up of a fuse F1, and four diodes CR1–CR4, together with a capacitor C1. The rectifier bridge is connected to an appropriate source of 60 Hz alternating current power. Fuse F1 may, for example, be a 1.5 ampfuse. Diodes CR1–CR4 may each be of the type designated 5395, and capacitor C1 may be a 60 microfarad capacitor. The fuse F1, diodes CR1–CR4, and capacitor C1 from a straight-forward full-wave rectified, capacitive filtered DC power supply with nominal output voltage of 160 volts DC at an input of 115 volts AC.

The switching regulator is designed around an integrating circuit U1 which may be of the type designated SGS3526. Integrated circuit U1 functions as a fixed frequency pulse generator and pulse width modulator. The output of the switching regulator is connected to a primary winding P1 of a power output transformer T1. The lamp to be energized by the power supply is connected across the secondary S1 of the output transformer. The power delivered to the lamp is modulated by varying the width, or duty cycle of the output pulses from integrated circuit U1, while the frequency of the pulses remains constant.

The integrated circuit U1 has two switched outputs, designated respectively "Out A" and "Out B" which appear at pins 13 and 16. These outputs are applied to the primary winding P1 of output transformer T1 through MOSFET output power devices Q4 and Q5. These power devices may be of the type designated 445–500A, and are rated at 500 volts and 4 amperes. Output A and output B of integrated circuit U1 are switched alternately so that the power output transformer T1 is driven in a push-pull mode. Transformer T1 is designed to have a high output voltage and a high output reactance in order to match the luminescent lamp drive requirements.

The frequency at which the outputs appearing at pins 13 and 16 are switched is constant and is fixed by the values of resistors R13 and R17 and capacitor C5. In the illustrated embodiment, resistor R13 has a value of 10 kilo-ohms, resistor R17 has a value of 22 ohms, and capacitor C5 has a value of 0.0022 microfarads. In the illustrated circuit, the nominal frequency is set at approximately 30 kH. As shown, pins 13 and 16 are connected to the respective gate electrodes of MOSFETs Q4 and Q5 through 100 ohm resistors R15 and R16, and the source electrodes of the MOSFETs are connected to ground through a common 0.1 ohm resistor R18 which is provided for test purposes only. Resistors R15 and R16 limit the maximum gate currents of the MOSFETs. MOSFETs Q4 and Q5 are of the type designated BUK445–500A.

Figure 2:
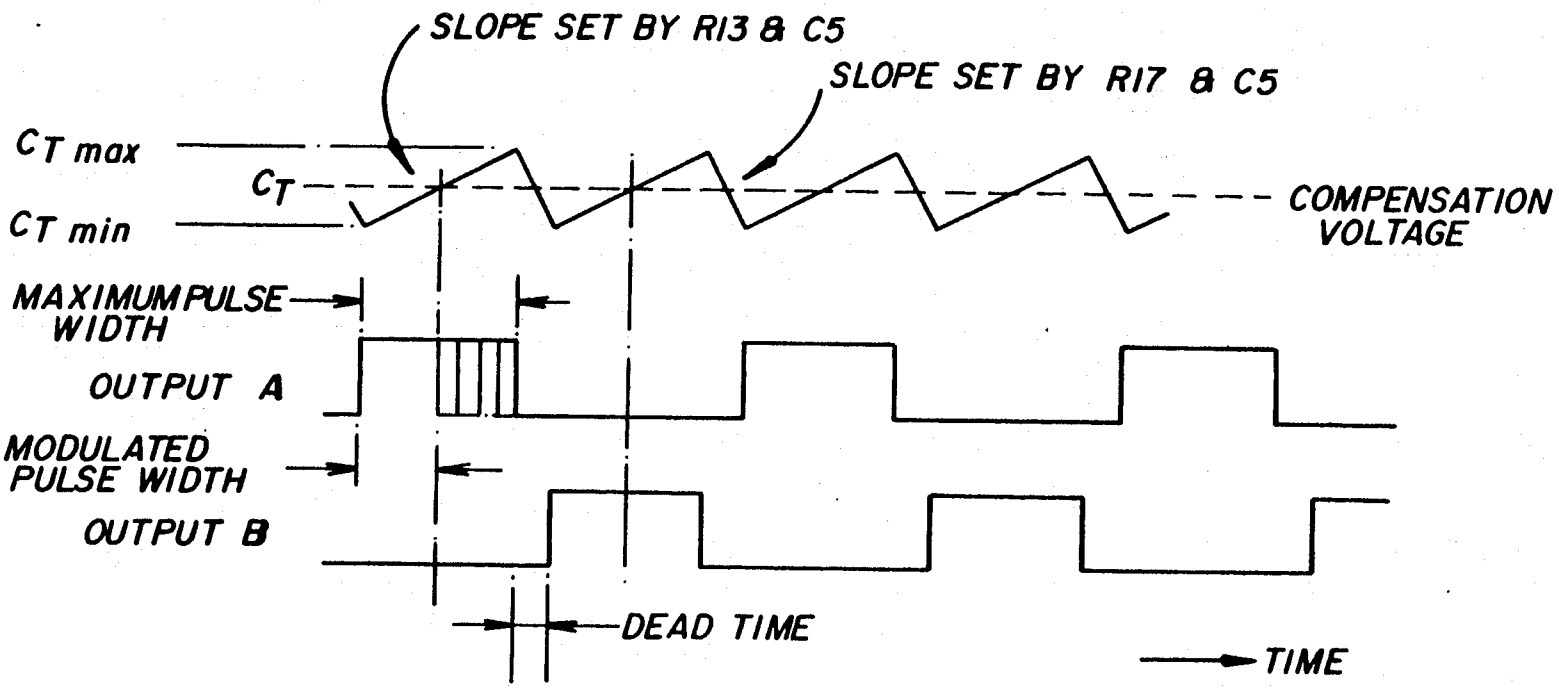
FIGS. 2, 3 and 4 are curves useful in explaining the operation of the power supply of FIG. 1.

The percentage of time that each of the outputs at pins 13 and 16 of integrated circuit U1 is on, that is the duty cycle, varies between 0 and something less than 50%. The maximum duty cycle of a single output is constrained to less than 50% in order to eliminate the possibility that both out put devices can be on at the same time. This is accomplished by establishing a dead time during which neither output can be on. The dead time is set by the value of resistor R17 in conjunction with the value of capacitor C5. The voltage at pin 10 (Ct) is a sawtooth waveform varying between two voltages with a frequency of twice the output frequency of the integrated circuit. The fall time of the sawtooth waveform is the dead time, as shown in the curve of FIG. 2. As shown in FIG. 2, the rise time of the sawtooth waveform is formed by the values of resistor R13 and capacitor C5.

The output pulse width is determined by comparing the sawtooth waveform at pin 10 with the voltage at the compensation pin 3. One or the other of the outputs appearing at pins 13 and 16 is turned on whenever the upward ramping voltage at pin 10 (Ct) is less than the voltage at the compensation pin 3. Thus, if the voltage at the compensation pin 3 is less than the minimum voltage at the Ct pin 10, the outputs will never go on. If the voltage at the compensation pin 3 is greater than the maximum voltage at Ct pin 10, the outputs will only be off during the dead time, that is, the output duty cycle will be at a maximum. For values at the compensation pin Ct between these extremes, the duty cycle will vary linearly with the voltage at Ct pin 10.

The integrated circuit U1 contains an error amplifier which is of the trans-conductance type which has a very high output impedance and in which the output current is proportional to the input error voltage applied to pins 1 and 2 of the integrated circuit U1. The output of this error amplifier is connected to the compensation pin which, in turn, is connected to a grounded microfarad capacitor C4. The voltage at the compensation pin is therefore proportional to the integral of input error, and this voltage continually increases or decreases as necessary until the error input goes to zero.

A 51 ohm resistor R14 is connected between pins 14 and 17 of integrated circuit U1 to limit feed-through currents within the integrated circuit which are created when the out puts are switched because of excessive internal device turn-off time.

Rectifiers CR6 and CR7 are connected to a secondary winding S2 of power transformer T1, and to pin 17 of integrated circuit U1. These rectifiers may be of the type designated IN4934. The rectifiers, together with capacitors C6 and C7 provide a DC voltage of 8–20 volts to power the integrated circuit U1. Capacitor C6 may have a value of 0.1 microfarad and capacitor C7 may have a value of 33 microfarads.

The rectifier bridge described above is connected to a start-up power supply. The start-up power supply is necessary because the integrated circuit U1 cannot become active until it is supplied with power, and the operating power supply cannot supply power until the integrated circuit is active. Accordingly, the start-up power supply shown in FIG. 1 is required.

The start-up power supply consists of a MOSFET Q1, whose gate electrode is driven from a voltage divider made up of a resistor R1 and resistor R2. Resistor R1 may have a resistance of 120 kilo-ohms and resistor R2 may have a resistance of 12 kilo-ohms. Resistor R1 is connected to the 160 volt DC power line A from the rectifier bridge described above. The values of the resistors R1 and R2 are selected that the voltage at the source electrode of the MOSFET Q1 is sufficient to turn on the integrated circuit U1 at the desired alternating current input voltage, but less than the voltage which is generated by the operating power supply once the integrated circuit is turned on. This insures that the start-up power supply, which is very inefficient, only serves to start the integrated circuit U1.

Once the integrated circuit U1 is started, the operating power supply raises the source voltage of the MOSFET Q1 and turns it off leaving the start-up power supply inactive. Resistor R3 which connects the drain electrode of MOSFET Q1 to the 160 volt DC line A provides a current limiting function to protect the MOSFET Q1 in the event of an abnormally high load which might be caused by an inadvertent short circuit to ground. MOSFET Q1 may be of the type designated MTP4N50.

The sensor bridge shown in FIG. 1 is primarily responsible for establishing and maintaining the brightness of the lamp driven by the power output transformer T1. The sensor bridge circuit incorporates three sensing elements, namely photoresistors R1 and Ra, and a thermistor RT. The photoresistors R1 and Ra have the property that their resistance is a strong negative function of the intensity of light falling on their faces. One of the photoresistors R1, is used to monitor the brightness of the lamp itself, and it is mounted adjacent to the lamp for that purpose. The other photo-resistor Ra is used to monitor the brightness of the incident ambient light, and it is appropriately mounted in a position to perform that function. The third sensing element RT, as mentioned, is a thermistor, and it is used to monitor the temperature of the lamp. The thermistor, likewise, is mounted in an appropriate position to perform its intended function.

As illustrated in FIG. 1, the sensors R1 and Ra are connected, together with a 750 ohm resistor R11 in series between pin 18 (V,ef) and ground. The resistor R11 and sensor Ra are shunted by a 0.1 microfarad capacitor C3 and a resistor R12. The resistance of resistor R12 may be, for example, 12 kilo-ohms where a white fluorescent lamp is being energized, or a resistance of 24 kilo-ohms in the event a neon lamp is being powered by the system.

Pin 18 is connected to a 5 kilo-ohm potentiometer R9 which, in turn, is connected to a grounded 5.1 kilo-ohm resistor R10. The junction of sensor R1 and resistor R11 is connected to pin 2 of the integrated circuit U1 (−error), and the movable arm of potentiometer R9 is connected to pin 1 (+error). Thermistor RT is connected across resistor R10, and is shunted by a 0.1 microfarad capacitor C2.

Sensors R1 and Ra, and potentiometer R9 and resistor R10 are connected essentially as a bridge whose voltage is monitored by the error amplifier in the integrated circuit U1. The bridge is balanced, and the error voltage is zero, when the ratio of the resistances of the photosensors R1 and Ra is equal to the resistances of potentiometer R9 and resistor R10. It will be appreciated that potentiometer R9 and resistor R10 form a reference voltage for the sensors R1 and Ra.

Figure 3:
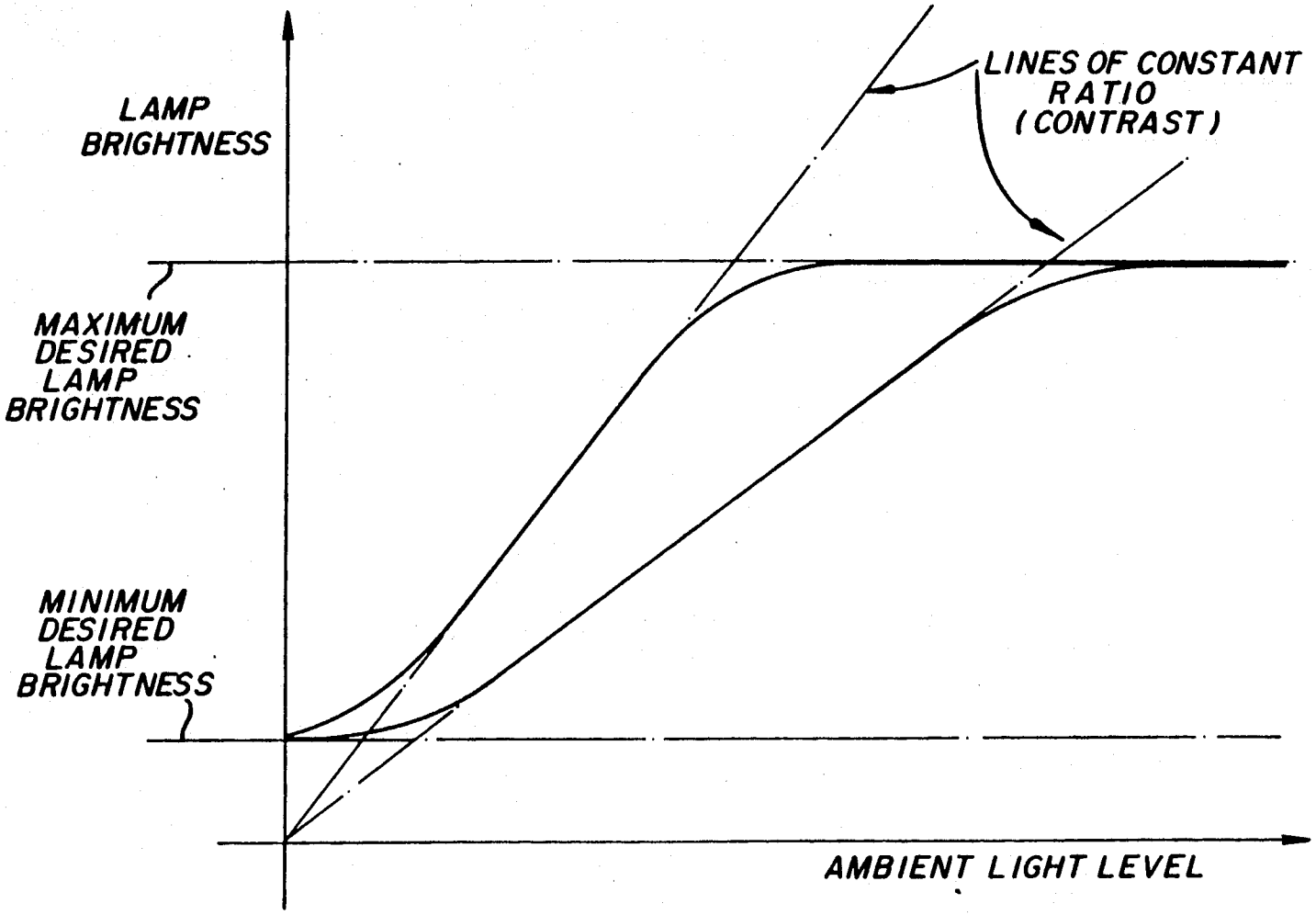

An error in the direction of a low ratio of lamp brightness to ambient brightness causes the output of the error amplifier in integrated circuit U1 to ramp up. This, in turn, causes the output duty cycle and consequently the power delivered to the lamp to increase. The lamp power will increase until the bridge is balanced and the error voltage is reduced to zero or, alternately, until the power reaches its maximum value, as shown by the curves of FIG. 3.

Alternately, if the bridge is unbalanced in the direction of a high ratio of lamp brightness to ambient brightness, the error amplifier in integrated circuit U1 will ramp down, reducing the output duty cycle and the lamp power until the bridge is again balanced. Accordingly, it can be seen that the bridge is configured to maintain the lamp power at that value required to establish a constant ratio between the resistances of photosensors R1 and Ra, and consequently a constant ratio between lamp brightness and ambient brightness. The particular ratio is set by the potentiometer R9 which establishes the bridge reference voltage at pin 1 (+error).

The only function of capacitors C2 and C3 is to reduce ripple and noise at the bridge output to a level which is tolerable to the error amplifier in the integrated circuit U1. Resistors R12 and R11 are incorporated to limit the maximum and minimum lamp brightness, as represented by the curves of FIG. 3. Resistor R12 is used to set the minimum light brightness, which is necessary because if the contrast were maintained at a constant level down to total darkness, the lamp would also be totally dark. In general, a minimum lamp brightness is required, no matter how low the ambient light level may become. Similarly, resistor R11 is incorporated for the establishment of a maximum light brightness which permits the power requirement to be limited in the case of extremely high ambient light levels.

The function of thermistor RT is to limit the upper temperature of the lamp. The power deliverable to the lamp is significantly higher than that which the lamp can handle at normal ambient temperatures in order to allow the rather dramatic fall off in lamp efficiency which occurs at low temperature. If, for any reason, this power level were to be delivered to the lamp for a long period of time and at high ambient temperatures, the lamp would overheat and turn off. The function of thermistor RT is to reduce the command contrast ratio when the lamp temperature approaches its maximum operating temperature.

The dynamic load circuit shown in FIG. 1 is of the type disclosed and claimed in Copending Application Ser. No. 514,143 filed Apr. 25, 1990, in the name of the present inventor. This circuit enables the power supply to present a low impedance to the line power source when the input power is turned off. This is so that external A/C switch leakage does not create appreciable voltages at the input terminals.

The dynamic load circuit includes a 200 kilo-ohm resistor R4, a Zener diode CR5 and a 13 kilo-ohm resistor R5 connected between the 160 volt DC line A and ground. The Zener diode may be of the type designated IN753A, and may have a rating of 10 volts. The junction of the Zener diode and resistor R5 is connected to the base of an NPN transistor Q2, which may be of the type designated 2N4401. The emitter of transistor Q2 is grounded, and its collector is connected to line A through a 200 kilo-ohm resistor R6. The collector of transistor Q2 is also connected to the gate of a MOSFET transistor Q3 which may be of the type designated MTB4N50. The drain of transistor Q3 is connected to line A, and the source is connected to a 220 ohm grounded resistor R7. The junction of Zener diode CR5 and resistor R4 is connected through a 13 kilo-ohm resistor R8 to the junction of resistor R7 and the source of MOSFET Q3.

Figure 4:
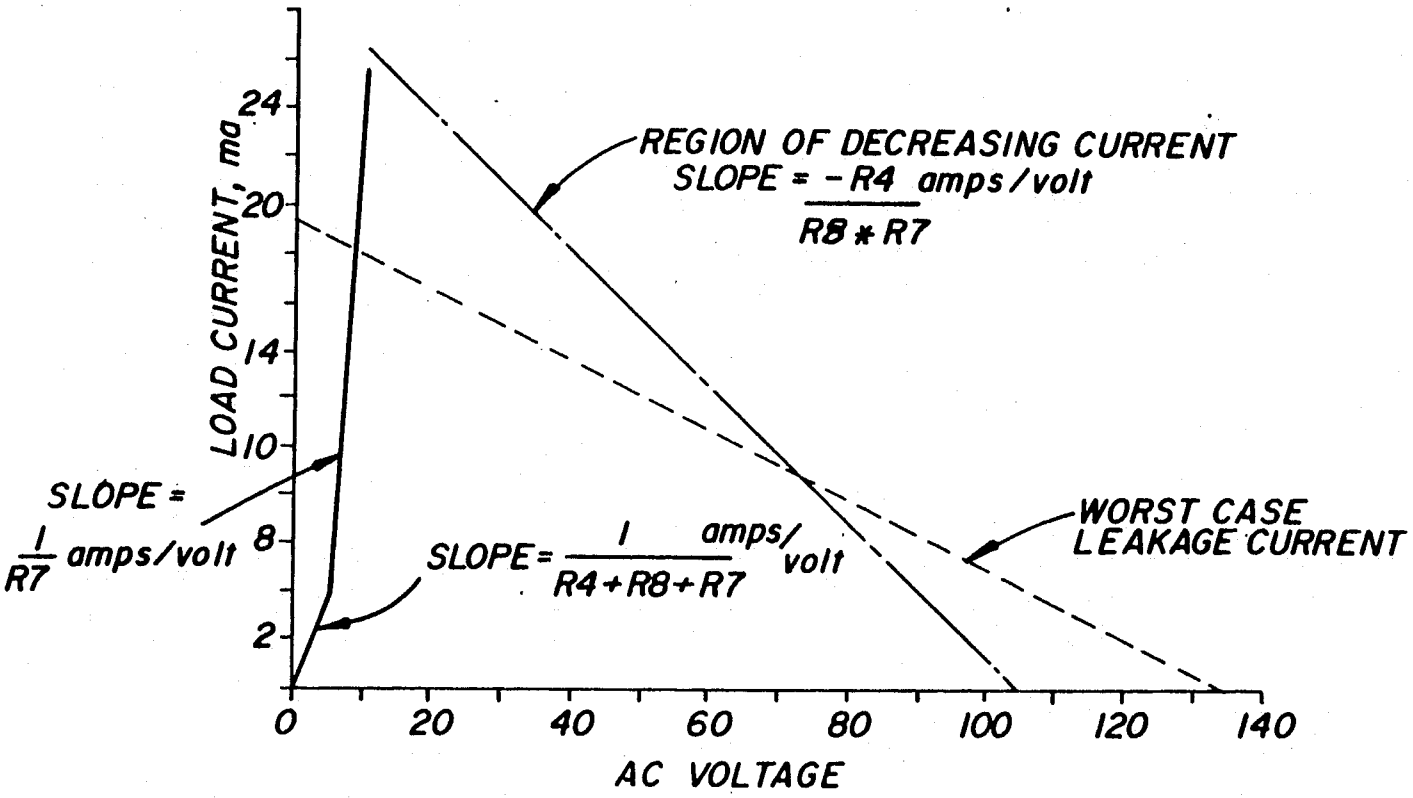

The dynamic load circuit is best viewed as a two terminal device with a unique volt/ampere characteristic. The circuit is configured such that the current shunted to ground is high at low voltages and low at high voltages. This requires that the impedance of the circuit be negative over some portion of its operating region, that is, the circuit is such that the current decreases over part of its operating region with increasing voltage. This characteristic is shown, for example, in the curve of FIG. 4.

The foregoing is accomplished by creating a two-stage inverting DC amplifier with a low impedance load and a defined off-set voltage. Transistor Q2 and resistor R6 form a common emitter high gain inverting stage, and MOSFET Q3 which forms the second stage is a source follower with low output impedance and a gain of one. Zener diode CR5 establishes the offset voltage. Resistor R4 forms the amplifier input resistor, and resistor R8 forms the feedback resistor, whereas resistor R7 forms the load resistor.

In the linear operating region, transistor Q2 is neither cut off nor saturated, and the closed loop voltage gain of the amplifier is approximately equal to $-R8/R4$. In this region, the dominant current in the circuit is the current through load resistor R7 which is proportional to the amplifier output voltage. Now, since the amplifier output voltage decreases with increasing input, the total circuit current must necessarily decrease as the input voltage increases.

At low input voltages the amplifier is cut off and the output voltage follows the input voltage minus the threshold voltage of MOSFET Q3. For inputs between zero and the threshold voltage of MOSFET Q3, the current increases slowly with input voltage. Once the threshold voltage of the MOSFET Q3 is exceeded the conductance of the circuit is positive and equal to that of load resistor R7, that is, the current increases with the increasing voltage at a proportionality factor of $1/R_7$.

The values of the various resistors R4, R5, R6, R7 and R8 and of Zener diode CR5 are selected to insure that, over the input voltage region which falls between the maximum allowable off-state voltage and the point at which the power circuit itself turns on, the current required by the dynamic load is greater than that of the off-state switch leakage current from the external solid state control switch.

In the foregoing manner, the dynamic load circuit achieves its desired purpose of insuring that the power supply presents a low impedance to the line power source when the power is off, so that external alternating current switch leakage cannot create appreciable voltages at the input terminals.

The invention provides, therefore, an improved power supply for a luminescent lamp, and which is designed so that the contrast between the light emitted by the lamp and ambient light is maintained constant throughout predetermined limits.

It will be appreciated that while a particular embodiment of the invention has been shown and described, modifications may be made. It is intended in the claims to cover all modifications which come within the true spirit and scope of the invention.

I claim:

1. A regulated solid state power supply for a luminescent lamp, and the like, in an external signal to maintain the signal effective and visible over a range of ambient light levels, said power supply comprising: a power transformer having a secondary winding across which a luminescent lamp may be connected and having a primary winding; a switching regulator circuit having an output connected to said primary winding; and a sensor bridge circuit connected to the input of said switching regulator circuit including a first light sensor for monitoring ambient light brightness and a second light sensor for monitoring the brightness of the luminescent lamp, said bridge circuit controlling the power introduced to said primary winding by said switching regulating circuit as a function of the ratio of lamp brightness to ambient light brightness so as to maintain the lamp power at a value required to establish a constant contrast between the light level of the signal and the ambient light level.

2. The regulated solid state power supply defined in claim 1, in which said switching regulator produces power pulses of a constant frequency and of a varying width, and in which said bridge circuit controls the width of said power pulses as a function of the ratio of lamp brightness to ambient light brightness.

3. The regulated solid state power supply defined in claim 1, and which includes resistance means included in said bridge circuit to limit the minimum and maximum brightness of the lamp.

4. The regulated solid state power supply defined in claim 1, and which includes thermistor means connected into said bridge circuit for limiting the maximum temperature of said lamp.

5. The regulated solid state power supply defined in claim 1, in which said power transformer has a second secondary winding, and a main direct current power supply circuit connected to said second secondary winding for supplying direct current power to said switching regulator circuit.

6. The regulated solid state power supply defined in claim 5, and which includes a start-up direct current power supply for said switching regulator circuit including circuit means connected to said main power supply for rendering said start-up power supply inactive when the voltage of said main power supply achieves a predetermined level.

* * * * *